US005249546A

United States Patent [19]

Pennelle

[11] Patent Number: 5,249,546

[45] Date of Patent: Oct. 5, 1993

[54] BOOKMARK

[76] Inventor: Joseph F. Pennelle, 3434 N. Nagel Ave., Chicago, Ill. 60634

[21] Appl. No.: 887,097

[22] Filed: May 22, 1992

Related U.S. Application Data

[63] Continuation-in-part of Ser. No. 571,321, Aug. 22, 1990, Pat. No. 5,140,934.

[51] Int. Cl.[5] ..... B42D 9/00; B42F 21/06

[52] U.S. Cl. ..... 116/234; 281/42; 283/41

[58] Field of Search ..... 116/234, 235, 236, 237, 116/238, 239, 240; 40/302, 357, 359, 360; 281/3.1, 15.1, 29, 38, 42, 45; 283/36, 37, 38, 39, 40, 41, 42, 43

[56] References Cited

U.S. PATENT DOCUMENTS

| | | | |
|---|---|---|---|
| 1,559,129 | 10/1925 | Pimm | 281/38 |
| 2,034,413 | 3/1936 | Ottinger | 281/42 |
| 2,344,613 | 3/1944 | Hellstern | 116/237 |
| 3,140,883 | 7/1964 | Anthony | 116/236 X |
| 4,184,699 | 1/1980 | Lowe, Jr. | 283/42 X |
| 4,448,310 | 5/1984 | Hodgson | 206/526 |
| 4,680,210 | 7/1987 | Corcoran | 283/38 X |
| 4,789,187 | 12/1988 | Corlew et al. | 281/15.1 |

FOREIGN PATENT DOCUMENTS

| | | | |
|---|---|---|---|
| 0851491 | 10/1952 | Fed. Rep. of Germany | 281/42 |
| 2526194 | 11/1983 | France | 40/638 |
| 0585130 | 1/1947 | United Kingdom | 281/42 |
| 0764283 | 12/1956 | United Kingdom | 116/239 |

*Primary Examiner*—William A. Cuchlinski, Jr.
*Assistant Examiner*—W. Morris Worth
*Attorney, Agent, or Firm*—Laff, Whitesel, Conte & Saret

[57] ABSTRACT

A printers convenience item may be added to a volume such as a book, magazine, folder containing a stack of papers or the like. The convenience item provides a bookmark which projects away from a side page in the volume so that it may fold over edges of the pages to act as a bookmark. In some embodiments the base of the bookmark is wide enough to function as a thumb tab. Preferably, the book mark is made of a durable material such as a heavy duty paper or a plastic paper substitute.

8 Claims, 4 Drawing Sheets

BOOKMARK

This is a continuation-in-part of Ser. No. 07/571,321, filed on Aug. 22, 1990 now U.S. Pat. No. 5,140,934.

This invention relates to publisher's sales aids, and more particularly to convenience items which not only increase the sales appeal of published items, but also provide such a consumer convenience that the consumer may wish to buy and add the items to preexisting products which they own.

In the case of a magazine and similar publications, a printer prepares publications which are sold to the reading public at a lower cost because much of the printing cost is subsidized by the advertisers whose advertisements appear therein. If a sales incentive can be added to the advertisement in order to induce readers to look at those pages, the price of the advertising page could be increased to decrease the price of the publication to the consumer. The price reduction would further increase the circulation of the publication and probably recover the added cost to the advertiser.

In the case of books, the advantage of such convenience items may not be so directly tied into an immediate return on investment. However, for many of the popular titles, textbooks, and the like, there may be an added incentive to select one publisher's books over the books of another publisher if a convenience item is added to the book.

Once people become accustomed to the convenience item, they may wish to buy it and add it to publications which they own and which were not originally produced with the convenience item in them.

For convenience of expression, the term "volume" is used and is to be construed herein as including any stack of pages that might be used with a bookmark, such volumes including books, magazines, bound or unbound papers in folders, and all other similar materials.

Accordingly, an object of the invention is to provide new and improved means for enhancing the convenience of printed items. Here, an object is to so enhance these items at almost no added cost. In particular, an object is to provide bookmarks which cannot be lost or misplaced and yet, which are always quickly and easily available for almost instant use with any bound volume.

Another object of the invention is to achieve the foregoing objects in a publication or volume which did not originally contain it. Here an object is to provide a convenience item which may be used in almost any of many places which may occur to people who have a need for the convenience provided by the item.

Still another object of the invention is to supply a bookmark which may be enclosed, built into, or part of cartons such as cereal boxes, soap boxes, baking products and the like that might induce consumers to buy products. Consumers seeing an array of similar products might be induced to purchase one over the other if by buying that particular item, they also obtained a free bookmark.

Another object of the invention is to provide a bookmark which can be separately attached to greeting cards, or may be in the form of a greeting card. Such markers could be die cut into any convenient shape, which ties into the content of the greeting card. For example, a greeting card might feature a well known cartoon figure in the form of a bookmark. When the greeting card purchaser sees that the receiver of the card will be provided with the gift of a bookmark which he can use again and again, the purchaser may be induced to buy such a greeting card over others that do no include a gift as part of the card's design.

In keeping with an aspect of the invention, these and other objects are achieved by a tab, flap, or finger member which may be built into a volume or other publication as an integral part thereof. The finger may function as a bookmark that cannot be lost; or, it may also be combined with an index tab marker for books, files or other volumes. The bookmark and tab function together because the flap is formed in a shape which is relatively broad close to the page and relatively narrow to provide both a tab and finger which is long enough to be folded over the marker, where it fits securely between the pages.

It is thought that after this convenience feature has caught the attention and acceptance of the public, they will want to add it to many different things such as preexisting books, magazines, file folders, and the like. Therefore, a pad of these finger members may have individual sheets with an adhesive on one side, and in the case of a self-adhesive, a release surface on the opposite side so that the adhesive sheets may be peeled off and used, as required.

Preferred embodiments of the invention are shown in the attached drawings wherein:

FIG. 5D shows a die cut bookmark, here in the image of a tube of toothpaste, although it could also be a well known cartoon character or the like;

Figure 1A:
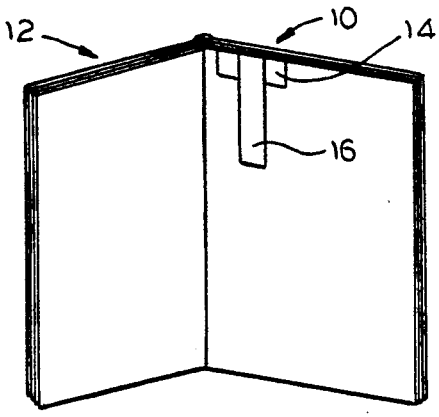
FIG. 1A shows, by way of example, the emplacement of the inventive item on the inside of the back cover of a volume, such as a book.

FIG. 1A shows a volume with the inventive item 10 emplaced, by way of example, on the inside surfaces of the back cover of a volume in the form of book 12. Here, a T-shaped sheet member 10 has the crossmember 14 of the T affixed to or adhered near the top of the inside cover (either front or back cover) with the stem 16 of the T folded over and completely free, flat against the inside cover.

Figure 1B:
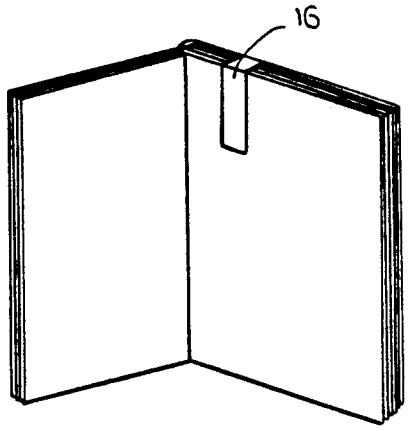
FIG. 1B shows a use of the inventive item of FIG. 1A.

FIG. 1B shows the stem 16 of the T in use as a bookmark. The bookmark cannot be lost and is easily returned to the inside of the book cover so that it is out of the way when the volume is in use, while remaining accessible for the next use.

Figure 2A:
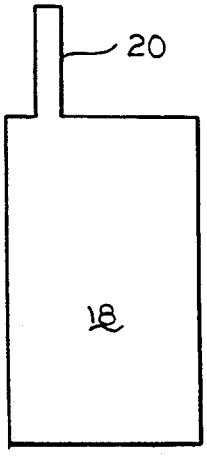
FIG. 2A shows the inventive item on a magazine page or cover.

FIG. 2A shows an embodiment preferably for use in bound or unbound structures such as a magazine, folder, notebook or the like. Here (FIG. 2C), the page 18 is initially cut with a finger 20 projecting therefrom. Then finger 20 is folded down approximately 3/16" from the top edge (as at 21) and over the page 18 (FIG. 2B) before it is bound into a volume such as a magazine, book, or the like. The term "a dimention" is used to include trimming in both a height and a width dimension. Therefore, when the pages of the volume are trimmed after it is bound, the finger is not cut off. That is, when the top edges of the pages are trimmed to give the bound volume a final and finished appearance, the top of the finger 20 of page 18 is far enough inside the book to escape the paper cutting knife and so the finger 20 remains attached for use as a bookmark. This is the preferred method of making finger 20 since an undersized page 18 might shift during binding. Thus, all pages of the volume should have the same outside dimensions before they are bound and trimmed.

Figure 2B:
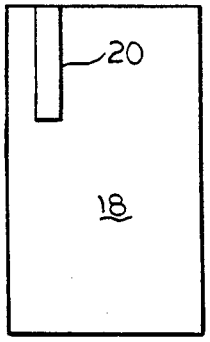
FIG. 2B shows a use of the inventive item of FIG. 2A.
Figure 3A:
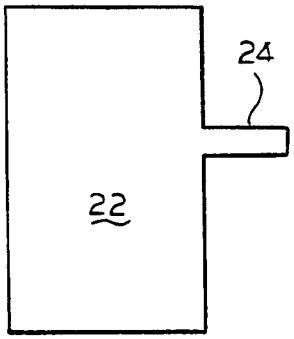
FIGS. 3A and 3B show another optional location of the inventive item on a side of a page or cover.
Figure 3B:
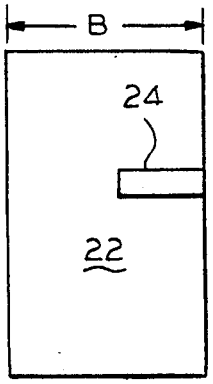
Figure 2C:
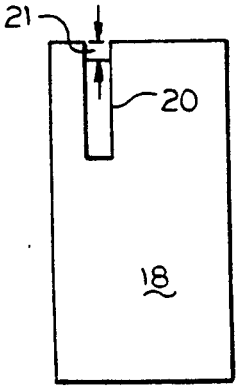
FIG. 2C shows how to construct the embodiment of FIG. 2A.

FIGS. 3A, 3B shows a substantially similar arrangement except that the projecting finger 24 is on the side instead of on the top of the page, as in FIGS. 2A, 2B. Here the width W of the page is slightly smaller than standard so that the finger 24 is not cut off when the side edges of the pages are trimmed.

Figure 4A:
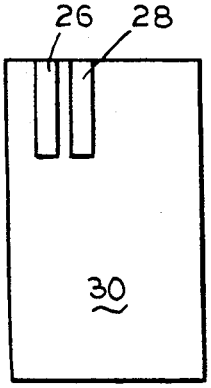
FIGS. 4A and 4B show multiple inventive items at different locations on the page or cover.
Figure 4B:
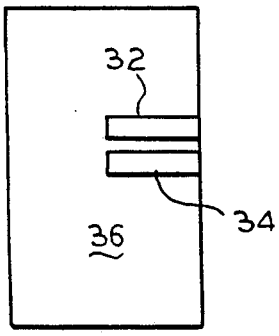

In FIGS. 4A, 4B, the principles of FIGS. 2, 3 are used to make multiple fingers 26, 28 at the top of page 30 or fingers 32, 34 at the side of page 36. Likewise, the finger may depend from the bottom of the page. Of course, any suitable number of fingers may be provided at any side or sides of the page. This way, in use, the multiple bookmarks may be placed at several different pages of the volume.

Figure 5A:
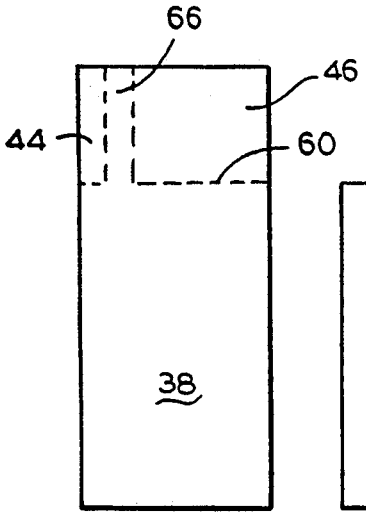
FIGS. 5A–5C show an embodiment wherein the inventive item is used in connection with tear out advertiser items.
Figure 5D:
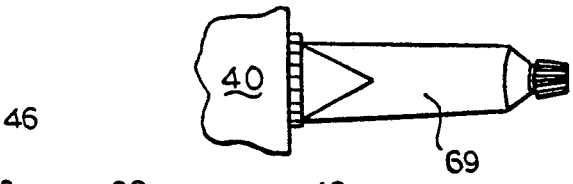
Figure 5B:
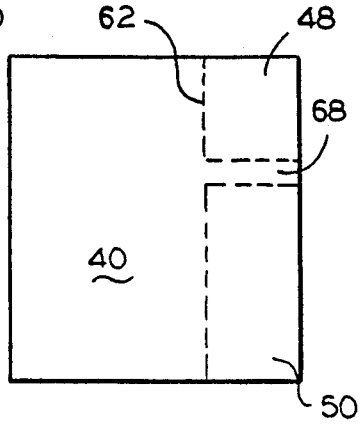
Figure 5C:
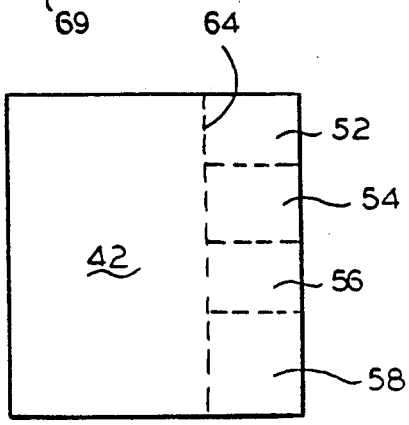

FIGS. 5A-5C show a different principle wherein a page 38-42 has an item or items 44-58 which are to be torn out by the person reading the publication. For example, item 44 might carry a lucky number to be retained for a sweepstakes drawing. Items 46, 48 may be return postcards. Item 50 might carry information such as a calendar, recipe, listing of interesting information, international telephone access codes, currency converter, metric measurements, or the like. Item 52-58 may be a collection of all of the above, or another and similar tear out item.

In any event, the tear out devices 44-58 fold along the lines 60, 62, 64 to a position completely within the publication (i.e., lines 60-64 correspond to approximately the edges of the volume). After the items 44-50 are torn off the page, a finger 66, 68 remains to act as a bookmark. In the example of FIG. 5C, it would be unlikely that all of the items 52-58 would necessarily be torn off the page. Therefore, those items which remain will function as one or more bookmarks.

In the case of FIG. 5D, the bookmark could have any suitable die cut shape or appearance, such as the image of a tube of toothpaste 69, or a roll of candy, a candy bar, a beverage container, or the like. Hence, this is an inducement for an advertiser to pay a little more for the advertisement on the page with the finger. Preferably, the base B of the die cut shape is wider than the tip T of this finger, which gives a mechanically stronger structure.

In each of the examples of FIGS. 2-5, the pages 18, 22, 30, 36, 38, 40, 42 may carry advertisement that is seen when the reader turns to use the finger as a bookmark.

The invention is particularly attractive when used on a page made of one of the modern plastic paper substitutes. A particularly attractive synthetic printing sheet is sold under the trademark "TESLIN" by PPG Industries, Inc., Teslin Products, 36th Floor, One PPG Place, Pittsburgh, Pa. 15272.

This "Teslin" material has the qualities of paper and may be bound in the volume as all pages are bound, and yet is tough enough to survive very rough usage as a bookmark. Therefore, either it or a competitive material is preferred, although paper, or other suitable material may be used to make the bookmark finger.

The manufacturer describes "TESLIN" as a single layer, highly filled, microporous, plastic film. The base material is in the polyolefin family, although the major component of the product is air—about 65 percent. "TESLIN" can be adapted to a wide range of printing and fabricating techniques. It accepts a broad variety of inks and can be printed with offset, inkjet, screen, laser, and thermal transfer processes. "TESLIN" is an uncoated film that inks, adhesive-s, coatings and laminating films can form bonds directly with the substrate.

| | PROPERTIES OF TESLIN | | | | | |
|---|---|---|---|---|---|---|
| | SP-700 | SP-800 | SP-1000 | SP-1400 | SP-1800 | ASTM Method |
| Gauge (mils) | 7.4 | 8 | 10 | 14 | 18 | D-374 |
| Tolerance (+/−mils) | 0.5 | 0.5 | 0.5 | 0.7 | 1.0 | |
| Yield (si/lb) +/−5% | 7700 | 6700 | 5200 | 3600 | 2550 | D-3776 |
| Basis Weight +/−5% | | | | | | |
| (oz/sq yd) | 2.69 | 3.09 | 3.99 | 5.76 | 8.13 | |
| (lbs/500 shts 25 × 38) | 62 | 71 | 91 | 132 | 186 | |
| (lbs/M sq yd) | 168 | 193 | 249 | 360 | 508 | |
| (sq yd/lb) | 5.94 | 5.17 | 4.01 | 2.78 | 1.97 | |
| Mill Roll Length (feet) | 6000 | 5250 | 4200 | 3300 | 2400 | |
| Roll Diameter (inches OD) | 28 | 28 | 28 | 28 | 28 | |
| Web Width (inches) | 25.75 | 25.75 | 25.75 | 25.75 | 25.50 | |

-continued

| | PROPERTIES OF TESLIN | | | | | |
|---|---|---|---|---|---|---|
| | SP-700 | SP-800 | SP-1000 | SP-1400 | SP-1800 | ASTM Method |
| Roll Weight (lbs) | 240 | 242 | 250 | 283 | 288 | |
| Tensile Properties | | | | | | |
| Tensile Strength (lb/in) | | | | | | |
| MD | 11.6 | 12.5 | 15.5 | 18.7 | 22.2 | D-882 |
| CD | 4.9 | 5.2 | 6.3 | 8.9 | 10.8 | |
| Elongation (%) | | | | | | |
| MD | 249 | 322 | 450 | 570 | 684 | D-882 |
| CD | 480 | 510 | 628 | 790 | 934 | |
| Elmendorf Tear | | | | | | |
| MD - notched (grams) | 53 | 67 | 109 | 201 | 293 | D-1992 |
| CD - notched (grams) | tore to md | tore to md | tore to md | tore to md | stretched | |
| Brittleness Temperature | <−70 deg C. | <−70 deg C. | <−70 deg C. | <−70 deg C. | <−70 deg C. | D-746 |
| Optical Properties | | | | | | |
| Brightness (%) | 96.7 | 97.2 | 97.2 | 97.3 | 97.5 | ISO-2470 |
| Whiteness (%) | 93.7 | 94.0 | 94.2 | 94.9 | 95.6 | |
| Opacity (%) | 94.1 | 95.4 | 96.3 | 97.6 | 99.0 | ISO-2471 |
| Transmission (%) | 11.4 | 9.9 | 8.8 | 6.1 | 3.7 | D-1003 |

This "Teslin" material has the qualities of paper and may be bound in the volume as all pages are bound, and yet is tough enough to survive very rough usage as a bookmark. Therefore, either it or a competitive material is preferred, although paper, or other suitable material may be used to make the bookmark finger.

Another such material from which the bookmark could be made is "KIMDURA" synthetic paper, made by Kimberly-Clark Corporation, 1400 Holcomb Bridge Road, Roswell, Ga., 30076. Kimberly-Clark has a latex saturated durable papers product line, featuring benefits in several critical areas including cost reduction. "KIMDURA" is a polypropylene film which is not only completely recyclable, but is so durable that it can be used for a long period of time before becoming part of the waste system. Other similar materials are sold under the trademarks "PREVAIL", "BUCKSIN", "TEXOPRINT", "TEXOPRINT II" and "DURAWEB", all which are manufactured by the Kimberly-Clark Corporation. Kimberly-Clark describe their entire line durable papers as having been designed for unique applications involving toughness and aesthetic excellence. They look, touch and feel as the long lasting durable papers.

Still other materials from which the bookmark could be manufactured include those sold under the trademarks "ASCOT" and "TYVEK," both of which are products of DuPont, Wilmington, Del. 19880-0705;

This material sold under the trademark "ASCOT" is made from 100% polyolefin filaments randomly dispersed and bonded to provide paper-like properties. To this base sheet, a specially formulated coatings are applied to assure high fidelity printing and to protect the filaments from the degrading effect of prolonged exposure to light. ASCOT requires the use of specially formulated ink containing no more than 3% volatile material to prevent swelling and distortion of the paper substitute material. High tack and viscosity inks are recommended to obtain even ink lay in solids and even tone in screen areas. ASCOT'S unusual features of strength, tear resistance, fold resistance, durability, water and light resistance and no grain direction, combined with its low weight to bulk ratio, offers endless applications.

Cellulose tear-resistant materials including Master-Flex Brand of Latex impregnated enamel providing a high quality sheets manufactured by Appleton. The material is a latex impregnated enamel providing a high quality sheet of paper substitute material which is formed on a fourdrinier machine with a unique makeup that enables the sheet to accept saturation process. After saturation, the web of Master-Flex material passes through squeeze rolls to remove excess saturants. Then, it is cured and dried. Double coaters apply the highly specialized coating, composed of clays, brighteners and adhesives, for producing a pinhole-free sheet. Supercalendered to a smooth, level surface with medium gloss finish, the Master-Flex material is designed primarily for offset printing, offering good ink holdout. Quick-set inks are recommended for both offset and letterpress production. The surface accepts varnishes, lacquers and adhesives and converting operations, such as sewing, diecutting and perforating. A sheet of this material can be folded and refolded without cracking or flaking.

Figure 15:
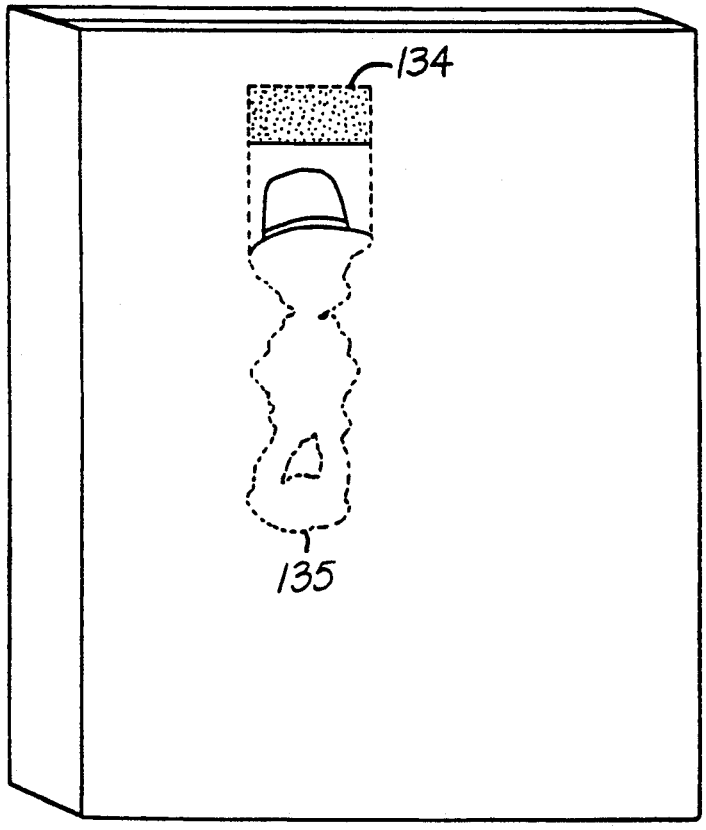
FIG. 15 is a perspective view of a box having a side with a perforated or otherwise marked section which may be torn or cut out to make a book mark.

Also, the book mark or tab mark 130 (FIG. 15) may be built into paperboard and cardboard cartons 132, such as cereal boxes, greeting cards, folders, binders, or the like, as shown in FIG. 15.

Other plastic paper substitutes or sturdy papers, paper boards, cardboards, or the like, of various strengths, may also be used to manufacture the book mark. Therefore, for convenience of expression all of these similar materials will be identified as "plastic paper substitutes" in this specification and in the claims.

In another embodiment, a T-shaped pad 70 (FIG. 6) may be provided. On the cross part 72 of the "T", each sheet in the pad has an adhesive on one side. The adhesive may be any suitable material such as a pressure sensitive, self-adhesive, or a glue which is wetted, for example. Thus, the adhesive may be a glue which is moistened and then stuck onto a page. When the adhesive is self-adhesive, or pressure sensitive, a release material is placed on the opposite side of the sheet bearing the adhesive. Therefore, each sheet may be peeled off the pad 70 one at a time and stuck at any convenient location on a volume such as a book, a magazine, or other device.

Figure 7A:
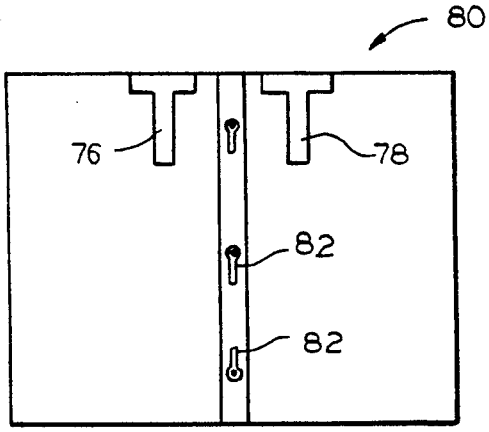
FIGS. 7A–7C show a few of the uses of the inventive items in connection with other structures.
Figure 7B:
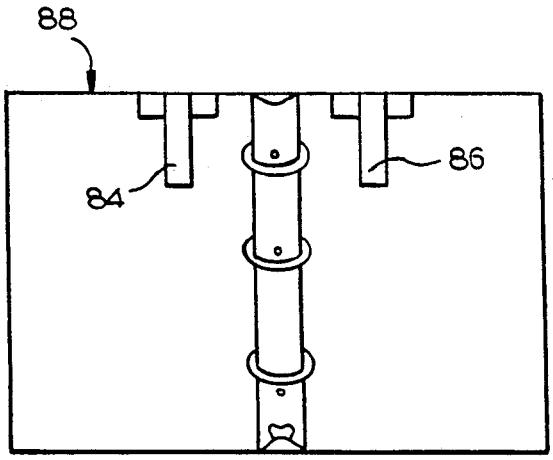
Figure 7C:
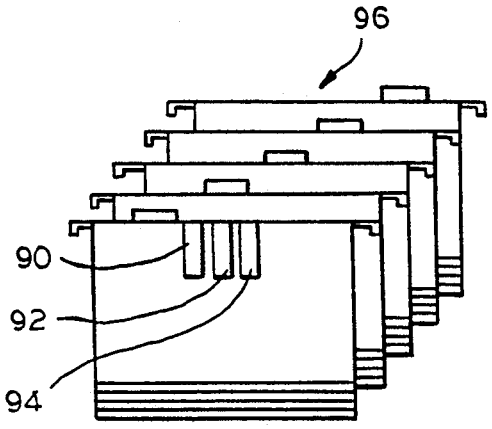

By way of example, FIG. 7A shows two of the T-shaped sheets 76, 78 stuck on the top edge of a binder folder 80 with fasteners 82. In FIG. 7B, the T-shaped sheets 84, 86 are stuck on the top edge of an inside surface of a looseleaf cover which may contain a volume of papers. In FIG. 7C, the T-shaped sheets 90–94 are stuck on an edge of a hanging file folder 96 which may eventually contain a volume of papers. One can easily think of many other uses for the invention.

FIGS. 8–14 show a bookmark which may also function as an index tab. Here a page 100 has a tab 102 of two widths formed thereon. One tab width 104 is suitable for use as a thumb tab 105 (FIG. 11) for indexing the pages of a book at least one side of the thumb tab was a surface which accepts written material so that the user may make notations thereon. The other tab width 106 is suitable for use as a bookmark. As indicated at 108, the tab 102 is cut deeply enough into the page 100 so that it may be folded over as also shown at 21 in FIG. 2C. This way the tabs may be positioned within the book so that they will not be cut away where the pages are trimmed.

Figure 12:
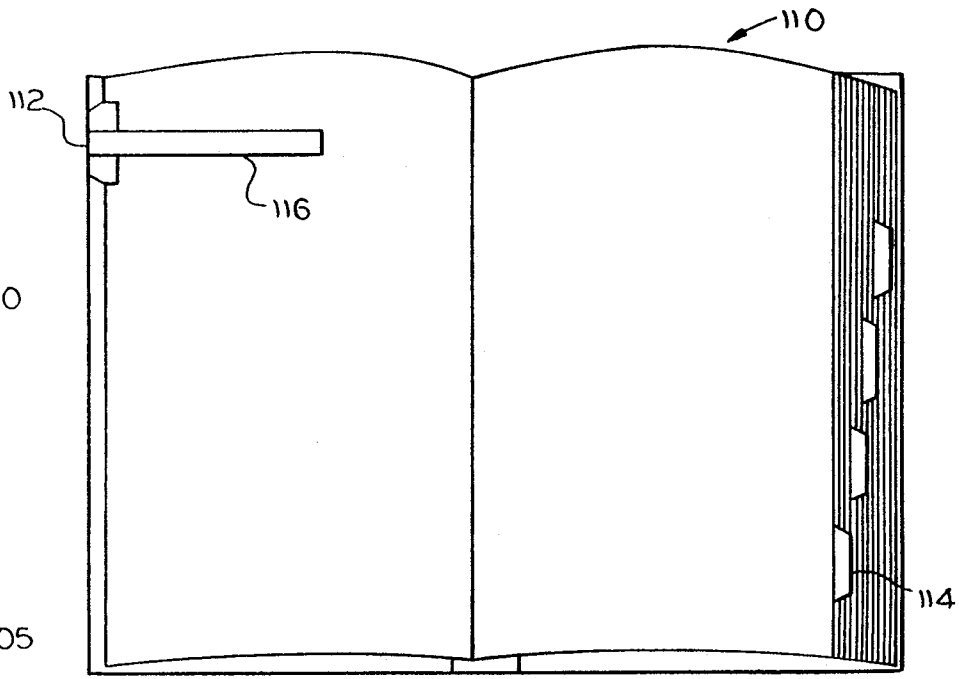
FIG. 12 is a perspective view showing a book with tabs and bookmarks, as shown in FIGS. 8–11.

FIG. 12 shows a book 110 which contains five pages with the tabs, two of Which are numbered 112 and 114. Any suitable member of such tabs may be provided. The bookmark tab 116 is here shown as folded back over the index tab 12. If some of the pages on the right side of the book are folded over to the left, the bookmark 116 may be placed between the pages.

Figure 6:
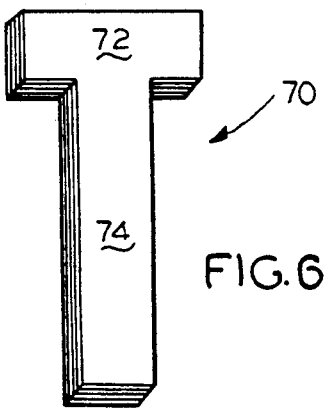
FIG. 6 is a perspective view of the inventive item which shows a pad of peel off bookmarks which may be used by the consumer at any convenient location.
Figure 14:
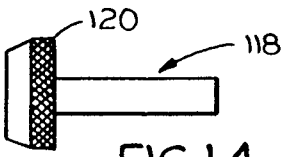
FIG. 14 is a showing of the combination of FIG. 13 which the bookmark folded over in the operative position.
Figure 13:
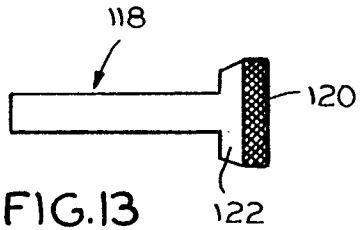
FIG. 13 is a plan view of an individual combination tab and bookmark.
Figure 9:
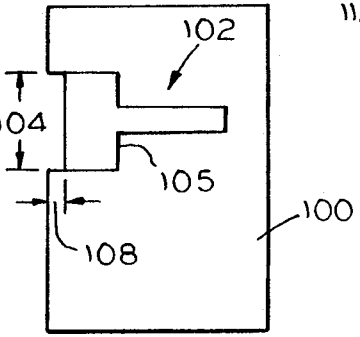
FIG. 9 shows a page, thumb tab, and bookmark with the tab and bookmark folded over, but before the page has been trimmed.
Figure 11:
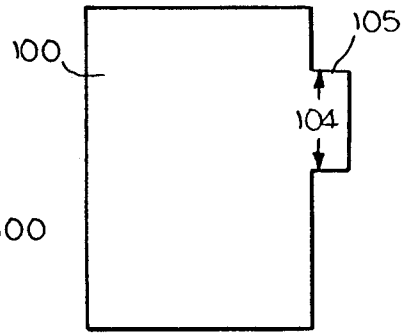
FIG. 11 shows the front of a volume page where the pre-attached tab maker and bookmark has been folded down.
Figure 8:
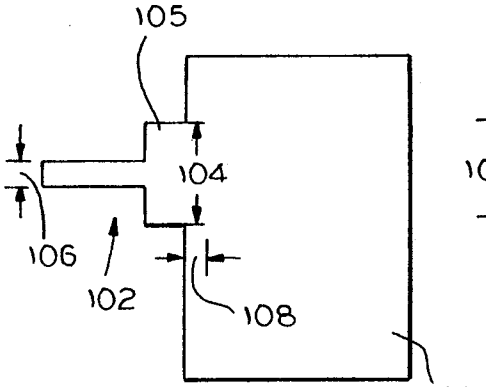
FIG. 8 shows a full die cut of a page of a volume with an integral tab and bookmark as manufactured.
Figure 10:
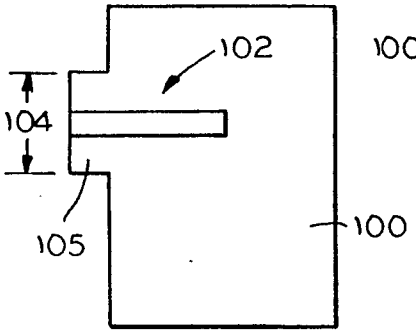
FIG. 10 shows the back of a volume page with the pre-attached tab marker and bookmark folded down into a place saving position.

FIGS. 13, 14 show a second embodiment of the "T-shaped" bookmark of FIG. 6. Here the separate device 118 is still T-shaped; however, the adhesive or other suitable bonding material 120 is distributed over approximately half of the cross bar 122 of the T, thus leaving the other half of the cross bar without adhesive so that it may function as an index tab 122 which projects beyond the page edge, as shown at 114 (FIG. 2).

The T-shaped bookmarks of FIGS. 6, 13 and 4 may preferably be made of a plastic paper substitute such as any of those sold under the trademarks "Teslin," "Prevail," "Texoprint," "Kimdura," "Ascot," "Tyvek," and "Master-Flex" for example.

The invention is an ideal "give away" for manufacturers, as premiums in boxes, as point of purchase give aways, as inserts in promotional mailings or the like. By way of example, FIG. 15 shows a cardboard box (such as a cereal box) with a cut out or perforated section 135. As there shown, the cutout is a well known cartoon character, with a suitable adhesive 134 on the tab position. An alternative is to have a separate die cut bookmark in the term of the cartoon (or other) character which is deposited in the box. Of course, an enclosure in any box of food has to be either made of or enclosed within FDA approved materials.

Those who are skilled in the art will readily perceive how to modify the invention. Therefore, the appended claims are to be construed to cover all equivalent structures which fall within the true scope and spirit of the invention.

What is claimed is:

1. A publisher's convenience item comprising a die cut generally T-shaped finger member made of a plastic paper substitute for attachment to a volume of pages; said generally T-shaped finger member having a cross member and a stem; said cross member of said T-shaped finger member having an adhesive on at least a part thereof for enabling the cross member of said finger member to be affixed to a page with said stem of said T-shaped finger member being non-affixed; wherein said cross member of said T-shaped finger member has two sections parallel to said cross member; one of said sections at a top of said cross member having said adhesive for attachment to said page; the other of said sections at the bottom of said cross member having no adhesive; said bottom section projection from one edge of said page when the top section is adhesively secured adjacent said edge of said page to form an index tab; and said stem of said T-shaped finger member, when folded over said projecting bottom section forming said index tab, defining a bookmark placeable between the pages of said volume of pages.

2. The item of claim 1 wherein the stem is in the form of a graphic outline.

3. The item of claim 1 wherein said adhesive is a pressure sensitive self-adhesive.

4. A publisher's convenience item comprising at least one page to be bound in with pages of a volume of pages, said one page having a die cut finger member projecting from an edge thereof, said finger having two widths, one of said widths being relatively wide to form an index tab projecting from said page, the other of said widths being relatively narrow to form a bookmark projecting from said index tab, said narrow width folding at a line where it joins said wide width in order to form a hinge thereat.

5. The item of claim 4 wherein a dimension of said one page extending in a direction of said finger member is slightly larger than a final dimensions in said direction of said one page with said finger member folded down to recess the hinge from a edge of said large dimension so that said finger is not cut off when said one page is trimmed.

6. A pad of convenience items comprising a plurality of die-cut T-shaped members assembled into a pad of peel off sheets, said T-shaped member having a configuration of cross member with an adhesive on one side and covering at least a part thereof for making attachment to an associated volume of pages, an elongate elongated stem projecting from said cross member, and a release surface on the opposite side of said cross member; wherein the T-shaped members are made of a plastic paper substitute, the cross member is tall enough to provide an index tab marker when said part is adhesively affixed adjacent an edge of one of said volume of pages, and said stem of said T-shaped member is long enough to fold over said one of said pages to form a bookmark.

7. The pad of claim 6 wherein the stem is in the form of a graphic outline.

8. The pad of claim 6 wherein said cross member has said adhesive covering approximately one half thereof so that a portion of said cross member extends outwardly to from a thumb tab when said part is adhesively affixed to said edge of sad one of said pages.

* * * * *